US005663744A

United States Patent [19]

Seike et al.

[11] Patent Number: 5,663,744

[45] Date of Patent: Sep. 2, 1997

[54] DRIVING METHOD FOR A LIQUID CRYSTAL DISPLAY

[75] Inventors: Takeshi Seike, Kitakatsuragi-gun; Masahiro Ise, Kashihara, both of Japan

[73] Assignee: Sharp Kabushiki Kaisha, Osaka, Japan

[21] Appl. No.: 612,408

[22] Filed: Mar. 7, 1996

[30] Foreign Application Priority Data

Mar. 22, 1995 [JP] Japan ..... 7-063187

[51] Int. Cl.[6] ..... G09G 3/36

[52] U.S. Cl. ..... 345/95; 345/94; 345/96

[58] Field of Search ..... 345/94, 95, 96, 345/208, 209, 210

[56] References Cited

U.S. PATENT DOCUMENTS

| | | | |
|---|---|---|---|
| 4,743,096 | 5/1988 | Wakai et al. | 345/94 |
| 4,945,352 | 7/1990 | Ejiri | 345/96 |
| 5,247,376 | 9/1993 | Wakai | 345/95 |

FOREIGN PATENT DOCUMENTS

| | | |
|---|---|---|
| 62-6210 | 2/1987 | Japan . |
| 3-64875 | 10/1991 | Japan . |
| 4-49712 | 8/1992 | Japan . |

OTHER PUBLICATIONS

U.S. application filed No. 08/499,162, Seike et al., Jul. 7, 1995.

*Primary Examiner*—Kee M. Tung
*Assistant Examiner*—Matthew Luu
*Attorney, Agent, or Firm*—Nixon & Vanderhye P.C.

[57] ABSTRACT

A driving method which is used for a display device and which applies different voltages to display elements during the first through third periods in a selection period. During the first period, a first voltage having not less than a predetermined value is applied to each display element through a non-linear element of two-terminal type. During the second period, a second voltage having a level that does not cancel the first voltage is applied upon on-time, while a second voltage having a level that cancels the first voltage is applied upon off-time. During the third period, a third voltage that has an opposite polarity to the first voltage upon on-time and that has the same polarity as the first voltage upon off-time is applied. Here, the third voltage has a non-selection level upon on-time as well as off-time. Thus, an effective voltage, which is applied to the display element selected during the selection period, becomes virtually the same irrespective of display states. Thus, the influence of data during the non-selection period hardly appear on the display during the selection period. This makes it possible to reduce generation of crosstalk to a great degree. Since the voltage to be applied to the display element is higher than a predetermined voltage, it is possible to reduce the dependance of the characteristic shift of the non-linear element on display states, and consequently to suppress afterimages and seizures.

12 Claims, 12 Drawing Sheets

DRIVING METHOD FOR A LIQUID CRYSTAL DISPLAY

FIELD OF THE INVENTION

The present invention relates to a driving method for displays which drives display elements in a display wherein non-linear elements are used as switching elements for pixels.

BACKGROUND OF THE INVENTION

In recent years, liquid crystal displays are widely used in a variety of fields, such as AV (Audio Visual) and OA (Office Automation) fields. In particular, liquid crystal displays of the passive type, which use TN (Twisted Nematic) and STN (Super Twisted Nematic) liquid crystal, are installed in those products of lower price. Further, liquid crystal displays of the active-matrix driving system, which use TFTs (Thin Film Transistors), that is, three-terminal non-linear elements, as switching elements, are installed in those products of higher price.

The liquid crystal displays of the active-matrix driving system have features that are superior to those of CRTs (Cathode Ray Tubes) in color reproducibility, thinness, light-weight and low power consumption, and the application of these displays has been rapidly expanding. However, the use of TFTs as switching elements require thin-film forming processes and photolithography processes of 6–8 times or more, resulting in high production costs. In contrast, liquid crystal displays using two-terminal non-linear elements as switching elements are less expensive to produce compared with those using TFTs and also exhibit superior display quality compared with those of the passive type. Therefore, the use of these displays has been rapidly developing.

As shown in FIG. 6, a liquid crystal display using the two-terminal non-linear elements has a display panel 1 wherein signal electrode lines $X_1$~$X_m$ and scanning electrode lines $Y_1$~$Y_m$ are disposed in a matrix form, in the same manner as a general liquid crystal display. To the signal electrode lines $X_1$~$X_n$, are applied predetermined voltages, that correspond to display data and which are released by a signal-electrode driving circuit 2 based on control signals from a control section 4. To the scanning electrode lines $Y_1$~$Y_m$, are applied predetermined voltages that are released by a scanning-electrode driving circuit 3 in a line-sequential manner based on control signals from the control section 4.

Further, as shown in FIG. 7, a liquid crystal element 5 and two-terminal non-linear element (hereinafter, referred to as two-terminal element) 6, which are connected in series with each other, are installed in each pixel that is formed at each intersection of the signal electrode lines $X_1$~$X_n$ and scanning electrode lines $Y_1$~$Y_m$.

In general, the characteristic of the two-terminal element 6 is represented by an I–V (current versus voltage) characteristic that is indicated by a solid line shown in FIG. 10. More specifically, this characteristic exhibits a minute current with a high equivalent resistance when the applied voltage of the two-terminal element 6 is low, and also exhibits an abruptly increased current with a low equivalent resistance when the applied voltage of the two-terminal element 6 is high. Therefore, this characteristic is utilized when a displaying operation is carried out by using the two-terminal element 6.

In other words, when a displaying operation is carried out, a voltage that allows the liquid crystal element 5 to turn on is applied thereto by applying high voltage to the two-terminal element 6 so that it has low-resistance. In contrast, in the case of an operation with no display, a voltage that makes the liquid crystal element 5 turn off is applied thereto by applying a low voltage to the two-terminal element 6 so that it has high-resistance.

Moreover, the voltage which has been applied to the liquid crystal element 5 during a selection period, is maintained since the two-terminal element 6 becomes high-resistive during a non-selection period. Therefore, it is possible to provide a high-duty driving operation in a display using the two-terminal element 6, compared with a simple-matrix display.

However, in the two-terminal element 6, the initial characteristic, as described above, varies with the applied voltage and time; this causes a problem wherein an afterimage phenomenon (also referred to as seizure phenomenon) occurs; that is, the present display is influenced by the previous displaying state.

This afterimage phenomenon is caused by the time dependence of the applied voltage in the I–V characteristic of the two-terminal element 6. In other words, as shown in FIG. 10, the I–V characteristic of the two-terminal element 6 Shifts from the state indicated by a solid line to the state indicated by a broken line as the voltage-applying time increases. For this reason, as shown in FIG. 11, a V-T (Voltage versus Transmittance) characteristic of the liquid crystal element 5 also shifts from the state indicated by a solid line to the state indicated by a broken line. At this time, for example, a voltage which provides a transmittance of 50% shifts from $V_{50}$ to $V_{50'}$. Here, the amount of shift differs depending on the applied voltage.

As a result, as shown in FIG. 12, the amount of shift (indicated by a solid line), which allows the liquid crystal element 5 to turn on, becomes greater than the amount of shift (indicated by a broken line) for turning the liquid crystal element 5 off, as the voltage-applying time increases. The increase in the difference of the amounts of shift causes adverse effects such as afterimages and seizures in the display.

Here, there have been proposed various manufacturing processes and structures of the two-terminal element 6, which can eliminate the above-mentioned shift in characteristic, as well as driving methods, which can eliminate the influence of shift in characteristic of the display state.

For example, Japanese Laid-Open Patent Publication No. 29748/1996 (Tokukaihei 8-29748) discloses a driving method wherein the selection period during which the scanning electrodes are selected is divided into two periods and wherein afterimage phenomenon is reduced irrespective of display states by applying a sufficient voltage during the first half of the period.

In a matrix-type display using liquid crystal and other materials, when a certain pattern (black portion) is displayed, a pattern (shaded portion), which is not related to the display information, tends to appear along an extended line of the displayed line, as shown in FIG. 13. This phenomenon, called crosstalk, arises mainly from the following two problems: one is due to rounding in waveforms that are caused by wiring resistances and parasitic capacities of the signal electrodes. The other is due to the fact that effective voltages, which are applied to the display elements, are fluctuated by influence of data signals during the non-selection period in the so-called duty driving operation which uses methods such as the voltage-averaging method that is well known as a driving method for simple-matrix-type liquid crystal displays.

In order to solve the former problem, the following countermeasures have been proposed by modifying the manufacturing processes and designs of the display panel: low resistance materials are used as electrode resistances; electrode resistances are modified so as to have a stacked-layer wiring structure; the wiring shape is modified; etc.

In the case when the two-terminal element 6 is used, it is possible to provide displays in high quality because its characteristic allows the voltage, which has been applied to liquid crystal during the selection period, to be maintained even during the non-selection period. However, in this case, although less influence is caused compared with the simple-matrix system, such as STN, crosstalk tends to occur due to the latter problem, since the influence of data signals during the non-selection period is not eliminated completely.

Referring to FIGS. 14 and 15, the following description will discuss the way crosstalk is generated. Here, for convenience of explanation, FIG. 14 shows a display state on a display panel wherein the number of pixels is eight per one line. More specifically, three display states are shown: (A) all pixels are turned on; (B) every other pixel is turned on; and (C) only one selected pixel is turned on. Further, the following description deals with only one frame portion of the frame inversion in the voltage-averaging method. Since it is easily assumed that the same effects would be obtained from one-line inversion and multiple-line inversion as long as display data are synchronous to the inversion cycle, the descriptions of those inversions are omitted.

In the above-mentioned display states of A through C, voltage waveforms, which are to be applied to the respective selected pixels, are indicated by $A_3$~$C_3$ in FIGS. 15(*a*) through 15(*c*). In each of FIGS. 15(*a*) through 15(*c*), a rectangular waveform portion, indicated by a solid line S, represents a waveform of voltage that is composed of a voltage applied by the signal electrode and a voltage applied by the scanning electrode, and a shaded portion represents a waveform of a voltage that is to be applied to a display element (liquid crystal in this case) through the non-linear element.

FIGS. 15(*a*) through 15(*c*) indicate that the effective values of the voltages that are to be applied to the respective selected pixels, $A_3$~$C_3$, are represented by $A_3>B_3>C_3$ since they are equivalent to the above-mentioned shaded portions and they are therefore different from one another. Moreover, since the transmittance of liquid crystal is dependent on the effective value of voltage, the selected pixels are displayed in black as shown in FIG. 14, for example, in the case when the display mode is set to normal white. With respect to the darkness of the displays, A is the darkest and C is the least dark. Also, with respect to the darkness of the displays of non-selection pixels, C is the least dark.

As shown in FIGS. 16(*a*) through 16(*c*), when the driving method of Japanese Laid-Open Patent Publication No. 29748/1996 (Tokukaihei 8-29748) is adopted, crosstalk can be reduced since the influence of data during the non-selection period is reduced to half, compared with the case shown in FIGS. 15(*a*) through 15(*c*), as indicated by $A_4$~$C_4$ (shaded portions) of applied voltage waveforms to the respective selected pixels in the display states of A through C. However, since there are still slight differences among the effective voltages that are to be applied to the pixels in the above-mentioned three display states, crosstalk is not completely eliminated. This causes a problem of degradation in display quality when the large-size panel with high duty is used for displaying and when gradational displays are made.

With respect to driving methods that provide for crosstalk prevention in liquid crystal displays using non-linear elements, the following three methods are listed:

In a driving method disclosed in Japanese Examined Patent Publication No. 6210/1987 (Tokukoushou 62-6210), the selection period has both the first period during which the scanning signal is set at the selected level and the second period during which the scanning signal is set at the non-selected level. In this driving method, the driving level is set so that, during the first period, the display signal has a level corresponding to image information and so that, during the second period, it has a level inverted to that of the first period.

Further, in a driving method which is disclosed in Japanese Examined Patent Publication No. 64875/1991 (Tokukouhei 3-64875) and which is applied to the case where signal polarities are inverted at every horizontal period, the selection period has the first period during which the scanning signal is formed into a selection-level signal and the second period during which the scanning signal is formed into a non-selection-level signal. In this driving method, the driving level is set so that the display signal is formed into level signals that are inverted between the selected and non-selected states depending on the first and second periods. More specifically, the display signal is formed into a selection or non-selection level signal that corresponds to image information during the first period. Then during the second period, the display signal is formed into a non-selection level signal when it was a selection level signal during the first period, and is formed into a selection level signal when it was a non-selection level signal during the first period.

Moreover, in a driving method disclosed in Japanese Examined Patent Publication No. 49712/1992 (Tokukouhei 4-49712), which is applied to the case of a two-frame ac system, the influence of data during the non-selection period is reduced by using virtually the same methods as the above-mentioned two driving methods.

The use of either of the above-mentioned driving methods is supposed to sufficiently reduce crosstalk caused by the influence of data during the non-selection period, since the variation of effective voltage that is to be applied to pixels can be suppressed.

However, the above-mentioned three driving methods fail to prevent afterimages, and in terms of display quality such as contrast, they can only achieve characteristics that are the same as those obtained by conventional commonly-used driving methods. Therefore, the problem of the above-mentioned driving methods is that the characteristics of non-linear elements cannot be fully utilized.

SUMMARY OF THE INVENTION

It is therefore an object of the present invention to provide a driving method for a display which can not only reduce crosstalk, but also suppress afterimages.

A first driving method of the present invention, which is applied to a display that is provided with a plurality of signal electrode lines and a plurality of scanning electrode lines that are disposed so as to intersect one another, and a display element and a non-linear element that are connected in series with each other between each signal electrode line and each scanning electrode line at each intersecting portion, has steps for sequentially selecting the scanning electrode line during each selection period, as well as for applying a voltage, which turns on or off the display element connected to the selected scanning electrode line, between the paired scanning electrode line and signal electrode line so as to drive the display element, with the selection period being divided into the first through third periods.

During the selection period, are further provided with the following steps of:

(a) during the first period, charging a first voltage having not less than a predetermined value to the display element through the non-linear element;

(b) during the second period, applying a second voltage that has a level that does not cancel the first voltage upon on-time, as well as applying a second voltage that has a level that cancels the first voltage upon off-time; and (c) during the third period, applying a third voltage that forms a non-selection level with the opposite polarity to the first voltage upon on-time, as well as applying a third voltage that forms a non-selection level with the same polarity as the first voltage upon off-time.

In the first driving method, the effective voltage, which is to be applied to the pixel (the display element and non-linear element) selected during the selection period, is set to become virtually the same irrespective of the display states by applying the voltages that are different with respect to the first through third periods. Thus, the influence of data during the non-selection period hardly appears on the display during the selection period. This makes it possible to reduce generation of crosstalk to a great degree.

Moreover, since the voltage that is to be applied to the display element during the selection period is maintained not less than a predetermined value irrespective of the on-state and off-state of the pixel, it is possible to reduce the dependance of the characteristic shift of the non-linear element on the display state. This makes it possible to suppress phenomena such as afterimages and seizure, and also to expand the operational margin in the voltage versus contrast characteristic. Consequently, the display quality can be improved.

In the above-mentioned first driving method, supposing that the first voltage is 1, the amplitude ratio of the second voltage to the first voltage is preferably set in a range from not less than −0.5 to less than 1 upon on-time, as well as set in a range from more than −1 to less than −0.5 upon off-time. The third voltage is preferably set to have an amplitude of ½ of the amplitude difference of the two second voltages during the on and off times, and also to be applied with opposite polarities during the second and third periods in the non-selection period. This arrangement provides a clear contrast between the applied voltage versus transmittance characteristic upon on-time and that upon off-time, thereby resulting in better contrast on the display screen. More preferably, the amplitude ratio of the second voltage to the first voltage is set in a range from not less than −0.9 to not more than −0.6 during the off time. This makes it possible to further improve the contrast.

In order to solve the above-mentioned driving method, a second driving method of the present invention includes steps for driving the display element in the same manner as the first driving method. In the these steps, during the selection period that is divided into the first through third periods, are further provided the following steps of:

(a) during the first period, charging a first voltage having not less than a predetermined value to the display element through the non-linear element;

(b) during the second period, applying a second voltage that has the opposite polarity to a third voltage but has the same absolute value as the third voltage that is to be applied during the third period; and (c) during the third period, applying a third voltage that has a level that does not cancel the first voltage upon on-time, as well as applying a third voltage that has a level that cancels the first voltage upon off-time.

In the second driving method also, the effective voltage, which is to be applied to the pixel selected during the selection period, is set to become virtually the same irrespective of the display states in the same manner as the first method. Thus, the influence of data during the non-selection period hardly appears on the display during the selection period. This makes it possible to reduce generation of crosstalk to a great degree.

Moreover, since the voltage that is to be applied to the display element during the first period is maintained at not less than a predetermined value irrespective of the on-state and off-state of the pixel, it is possible to reduce the dependance of the characteristic shift of the non-linear element on the display state. This makes it possible to suppress phenomena such as afterimages and seizure, and also to expand the operational margin in the voltage versus contrast characteristic.

Furthermore, in the above-mentioned method, a voltage corresponding to the selection level is applied during any of the first through third periods; therefore, the combination of voltages of the respective periods can be optimized so as to reduce the voltage variation during the selection period. Consequently, it becomes possible to reduce the voltage variation of driving-use ICs that achieve the above-mentioned driving method.

In the above-mentioned second driving method, supposing that the first voltage is 1, the amplitude ratio of the second voltage to the first voltage is preferably set in a range from not less than −0.5 to not more than 0.5 upon on-time, as well as set in a range from more than 0.5 to less than 1 upon off-time. Further, the amplitude ratio of the third voltage to the first voltage is preferably set in a range from not less than −0.5 to not more than 0.5 upon on-time, as well as set in a range from more than −1 to less than −0.5 upon off-time. This arrangement provides a clear contrast between the applied voltage versus transmittance characteristic upon on-time and that upon off-time, thereby resulting in better contrast on the display screen. More preferably, the amplitude ratio of the third voltage to the first voltage is set in a range from not less than −0.9 to not more than −0.6 upon off-time. This makes it possible to further improve the contrast.

For a fuller understanding of the nature and advantages of the invention, reference should be made to the ensuing detailed description taken in conjunction with the accompanying drawings.

BRIEF DESCRIPTION OF THE DRAWINGS

FIG. 2(*a*) is a waveform drawing that shows a waveform of voltage to be applied to a liquid crystal element by the driving method of FIG. 1 in a display state where all the element in one line are turned on.

FIG. 2(*b*) is a waveform drawing that shows a waveform of voltage to be applied to a liquid crystal element by the driving method of FIG. 1 in a display state where every other pixel in one line is turned on.

FIG. 2(*c*) is a waveform drawing that shows a waveform of voltage to be applied to a liquid crystal element by the driving method of FIG. 1 in a display state where a single specify pixel among pixels in one line is turned on.

FIG. 4(*b*), which are commonly used in each of the embodiments of the present invention, is a graph that shows the applied voltage vs. transmittance characteristic in the case when the amplitude ratio of selected voltages is changed upon off-time in the driving methods of the two embodiments.

FIG. 9(*a*) is a waveform drawing that shows a waveform of voltage to be applied to a liquid crystal element by the driving method of FIG. 8 in a display state where all the elements in one line are turned on.

FIG. 9(*b*) is a waveform drawing that shows a waveform of voltage to be applied to a liquid crystal element by the driving method of FIG. 8 in a display state where every other pixel in one line is turned on.

FIG. 9(*c*) is a waveform drawing that shows a waveform of voltage to be applied to a liquid crystal element by the driving method of FIG. 8 in a display state where a single specific pixel among pixels in one line is turned on.

FIG. 15(*a*) is a waveform drawing that shows a waveform of voltage to be applied to a liquid crystal element by a conventional driving method in a display state where all the elements in one line are turned on.

FIG. 15(*b*) is a waveform drawing that shows a waveform of voltage to be applied to a liquid crystal element by the conventional driving method in a display state where every other pixel in one line is turned on.

FIG. 15(*c*) is a waveform drawing that shows a waveform of voltage to be applied to a liquid crystal element by the conventional driving method in a display state where a single specific pixel among pixels in one line is turned on.

FIG. 16(*a*) is a waveform drawing that shows a waveform of voltage to be applied to a liquid crystal element by another conventional driving method in a display state where all the elements in one line are turned on.

FIG. 16(*b*) is a waveform drawing that shows a waveform of voltage to be applied to a liquid crystal element by the above-mentioned conventional driving method in a display state where every other pixel in one line is turned on.

FIG. 16(*c*) is a waveform drawing that shows a waveform of voltage to be applied to a liquid crystal element by the above-mentioned conventional driving method in a display state where a single specific pixel among pixels in one line is turned on.

DESCRIPTION OF THE EMBODIMENT

Embodiment 1

Referring to FIGS. 1 through 7, the following description will discuss one embodiment of the present invention.

Figure 6:
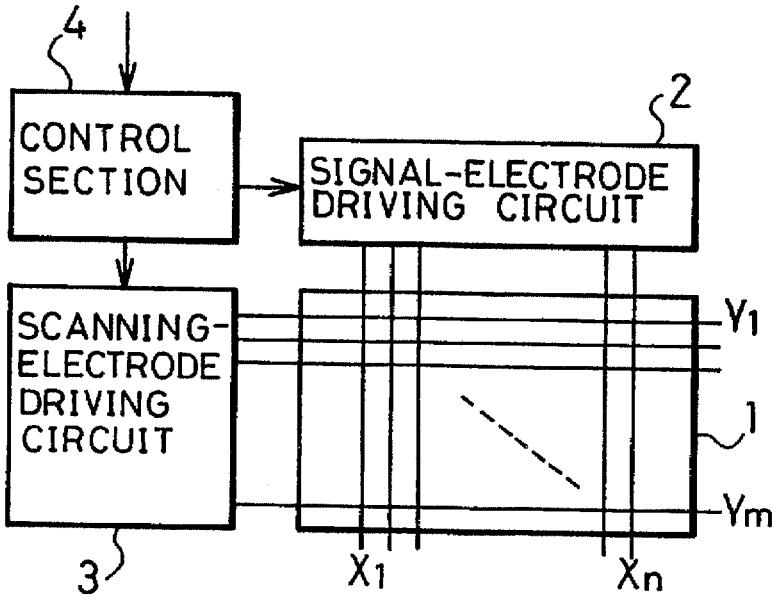
FIG. 6, which is commonly used in each of the embodiments and a conventional arrangement, is a block diagram showing a main structure of a liquid crystal display.

As illustrated in FIG. 6, a liquid crystal display of the present embodiment is provided with a display panel 1, a signal-electrode driving circuit 2, a scanning-electrode driving circuit 3, a control section 4, signal electrode lines $X_1$~$X_n$, and scanning electrode lines $Y_1$~$Y_m$.

The display panel 1, which is placed in a region wherein the signal electrode lines $X_1$~$X_n$ and the scanning electrode lines $Y_1$~$Y_m$ intersect one another in the form of a matrix, is used for displaying images. The signal-electrode driving circuit 2 applies predetermined voltages corresponding to display data to the signal electrode lines $X_1$~$X_n$. The scanning-electrode driving circuit 3 applies predetermined voltages to the scanning electrode lines $Y_1$~$Y_m$ in a line-sequential manner. Although not shown in the drawings, the signal-electrode driving circuit 2 and the scanning-electrode driving circuit 3 are commonly constituted of shift registers, analog switches, and other parts.

In accordance with inputted display data and other data, the control section 4 generates control signals that are to be sent to the signal-electrode driving circuit 2 and the scanning-electrode driving circuit 3. In other words, as will be described later, the control section 4 controls the signal-electrode driving circuit 2 and the scanning-electrode driving circuit 3 so that during a selection period that are divided into three periods, different voltages are applied to a liquid crystal element 5 in response to the respective periods.

Figure 7:
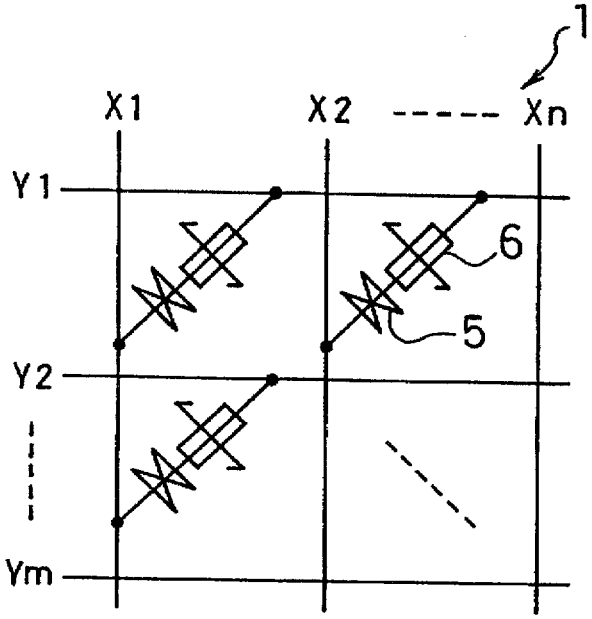
FIG. 7 is a circuit diagram that shows a detailed structure of a display panel of the liquid crystal display of FIG. 6.

In the display panel 1, the liquid crystal element 5 and a two-terminal element (two-terminal-type non-linear element) 6, shown in FIG. 7, are installed in each of regions that are divided by the signal electrode lines $X_1$~$X_n$ and the scanning electrode lines $Y_1$~$Y_m$, and these components form a pixel. The liquid crystal element 5, which functions as a display element, and the two-terminal element 6, which functions as a non-linear element, are connected in series with each other. One of the electrodes of the liquid crystal element 5 is connected to a specific one of the signal electrode lines $X_1$~$X_n$ and one of the electrodes of the two-terminal element 6 is connected to a specific one of the scanning electrode lines $Y_1$~$Y_m$.

Figure 1:
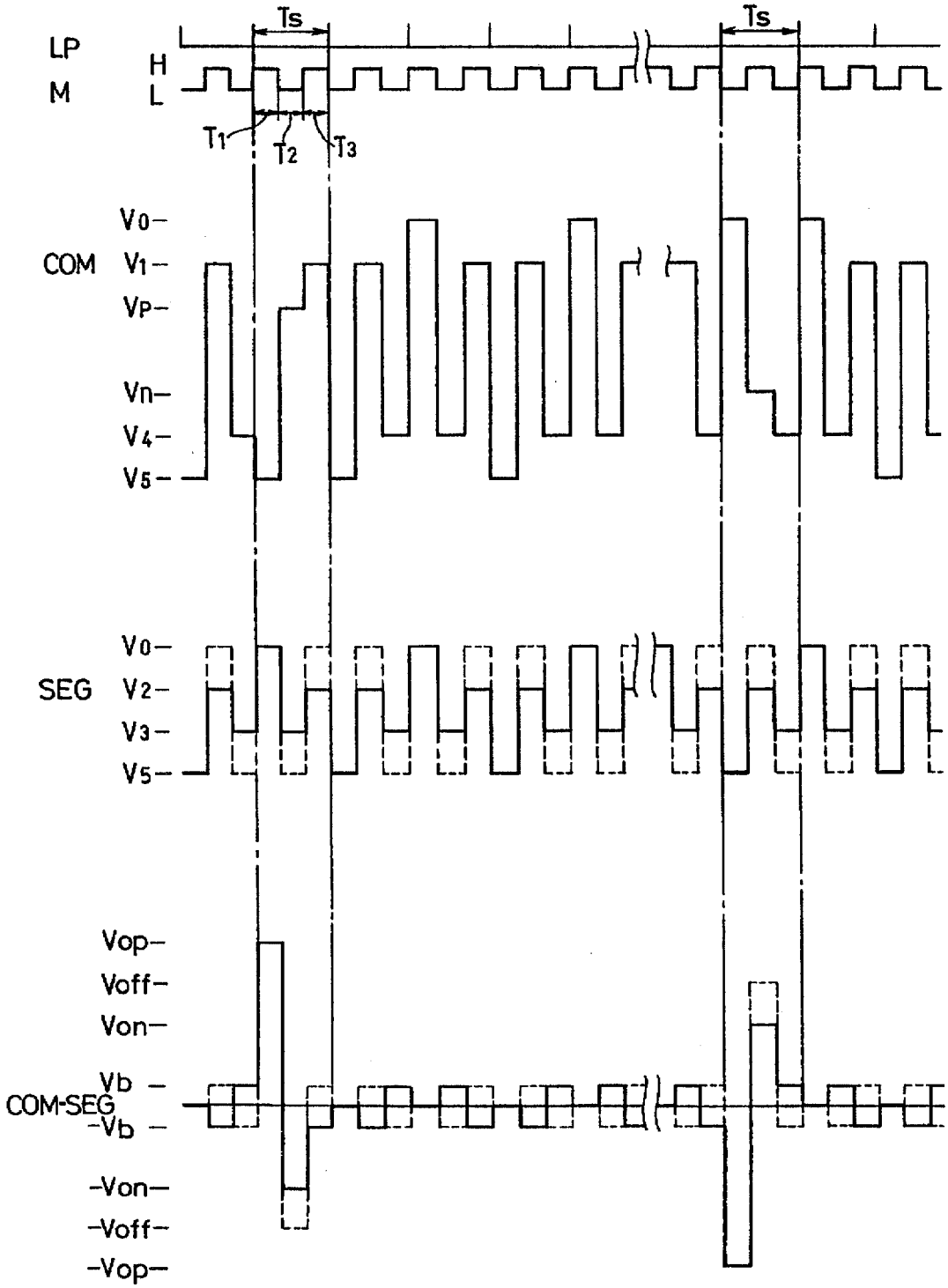
FIG. 1 is a waveform drawing that show signal waveforms to be used for explaining a driving method of a liquid crystal display of one embodiment of the present invention.

Referring to FIG. 1, the following description will discuss a driving method that is used for a liquid crystal display having the above-mentioned arrangement.

In FIG. 1, LP represents a signal for forming each selection period $T_s$, and M represents an ac conversion signal which inverts in a constant cycle. LP and M are contained in the control signals that are supplied from the control section 4.

COM represents a signal waveform that is applied to the scanning electrode lines $Y_1$~$Y_m$ by the scanning-electrode driving circuit 3 and that is denoted by six voltages $V_0$, $V_1$, $V_p$, $V_n$, $V_4$ and $V_5$. SEG represents a signal waveform that is applied to the signal electrode lines $X_1$~$X_n$ by the signal-electrode driving circuit 2 and that is denoted by four voltages $V_0$, $V_2$, $V_3$ and $V_5$. COM-SEG represents a signal waveform that is applied to both ends of each pixel and that is denoted by eight voltages $V_{op}$, $V_{off}$, $V_{on}$, $V_b$, $-V_b$, $-Y_{on}$, $-V_{off}$ and $-V_{op}$. In this waveform COM-SEG, a solid line represents a waveform upon on-time and a broken line represents a waveform upon off-time.

The above-mentioned voltages $V_0$ through $V_5$ are voltages of six levels that are required for driving liquid crystal, and $V_p$ and $V_n$ are voltages used for determining the ratios of voltages $\pm V_{on}$ and $\pm V_{off}$ to the amplitude of the voltage $\pm V_{op}$ for charging the respective liquid crystal elements 5. Here, the voltages $\pm V_{on}$ are applied voltages for turning the liquid crystal element 5 on. Also, the voltages $\pm V_{off}$ are applied voltages for turning the liquid crystal element 5 off. The values of the voltages $V_{on}$ and $V_{off}$ vary slightly depending on conditions of the display panel 1, such as characteristics of the liquid crystal element 5, characteristics of the two-terminal element 6 and capacity ratio, as well as depending on specific driving conditions, such as frame frequency and duty ratio.

In the liquid crystal display of the present embodiment, the selection period $T_s$ is divided into three periods, that is, the first through third periods $T_1$ through $T_3$, and driving voltages (voltages applied to the pixels) are applied during the respective periods.

The first period $T_1$ is a period during which a voltage having not less than a predetermined value is charged to the display element 5 through the two-terminal element 6. The second period $T_2$ is a period during which a voltage having a level that does not cancel the voltage charged during the first period $T_1$ upon the on-time of the liquid crystal element 5, and during which a voltage having a level that cancels the voltage charged during the first period $T_1$ upon the off-time of the liquid crystal element 5, in accordance with display states, and the selection level is taken during this period. The third period $T_3$ is a period during which a voltage having the opposite polarity to the voltage (the first voltage) charged during the first period $T_1$ upon the on-time of the liquid crystal element 5 and during which a voltage having the same polarity as the above-mentioned charged voltage upon the off-time of the liquid crystal element 5. Here, the voltages are set to values that are within the non-selection level upon the on- and off-times of the liquid crystal element 5.

The applied voltages during the second period $T_2$ and the third period $T_3$ are set as follows:

During the second period $T_2$, supposing that the amplitude of voltage $V_{op}$ is 1, an applied voltage (the second voltage) is set so that the amplitude ratio $R_1$ ($=V_{on}/V_{op}$) of the applied voltage ($V_{on}$) upon on-time is set in a range from not less than −0.5 to less than 1, and that the amplitude ratio $R_2$ ($=V_{off}/V_{op}$) of the applied voltage ($V_{off}$) upon off-time is set in a range from more than −1 to less than −0.5. During the third period $T_3$, an applied voltage (the third voltage) is set so as to have an amplitude of ½ of the amplitude difference of the applied voltages upon on- and off-times during the second period $T_2$. Moreover, the non-selection period is also divided into the first through third periods, that is, $T_1$ through $T_3$, in the same manner as the selection period $T_s$, and applied voltages are set so as to have opposite polarities during the second and third periods of these periods.

Here, the sign (−) in the above-mentioned amplitude ratio indicates the opposite polarity.

Figure 14:
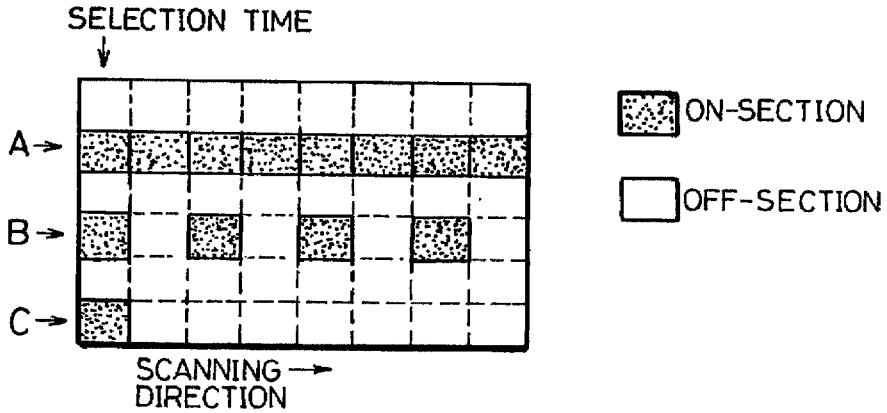
FIG. 14 is an explanatory drawing that shows three display states used for explaining causes of crosstalk.
Figure 15A:
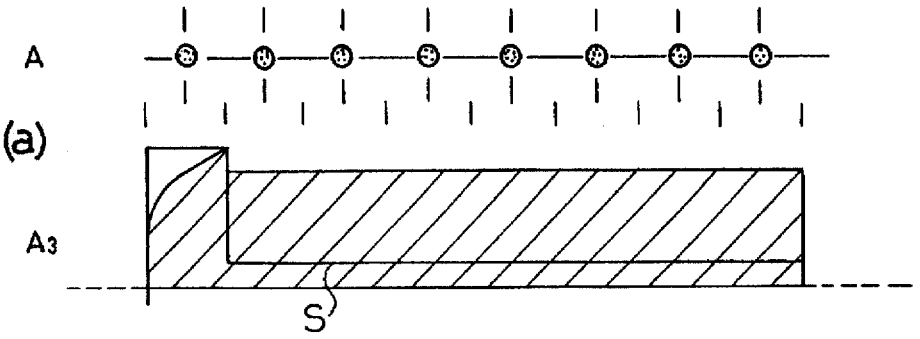
Figure 15B:
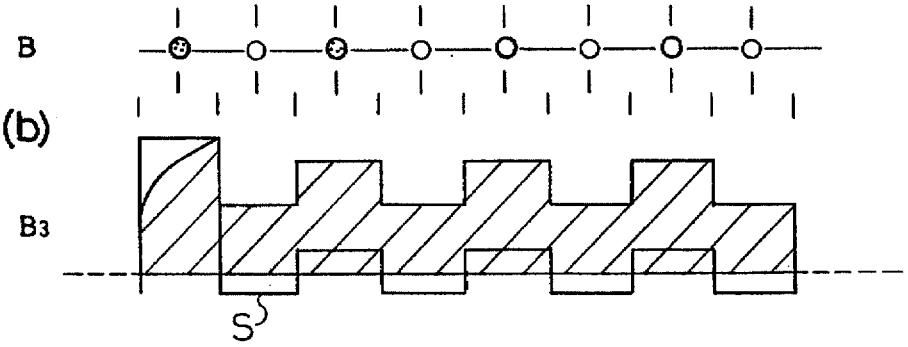
Figure 15C:
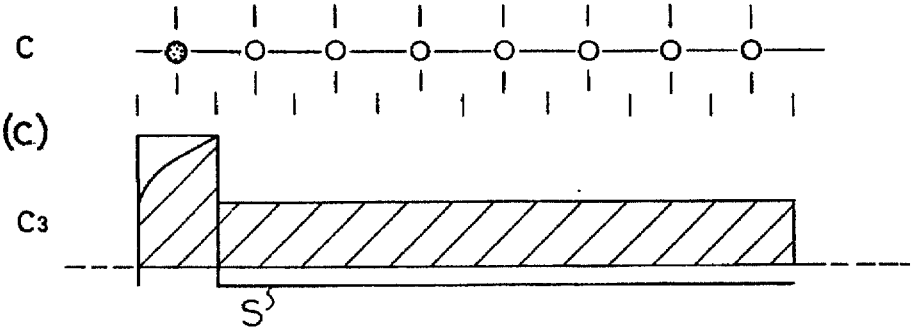
Figure 16A:
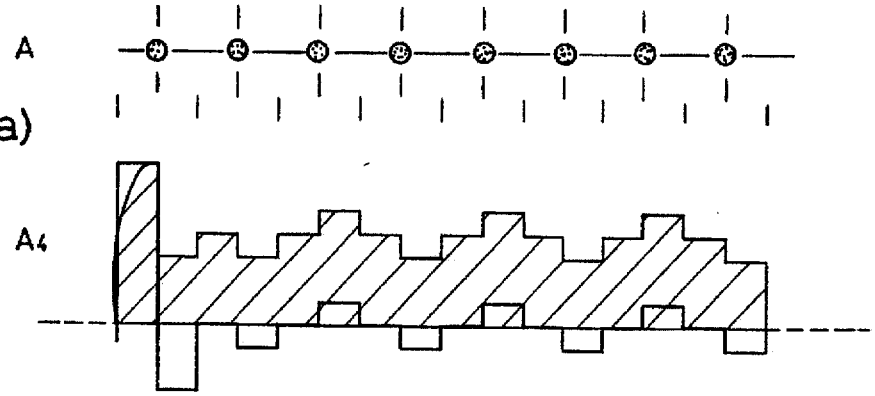
Figure 16B:
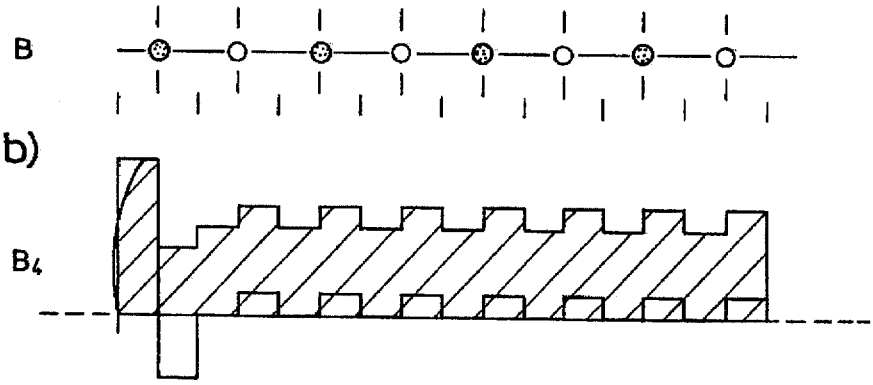
Figure 16C:
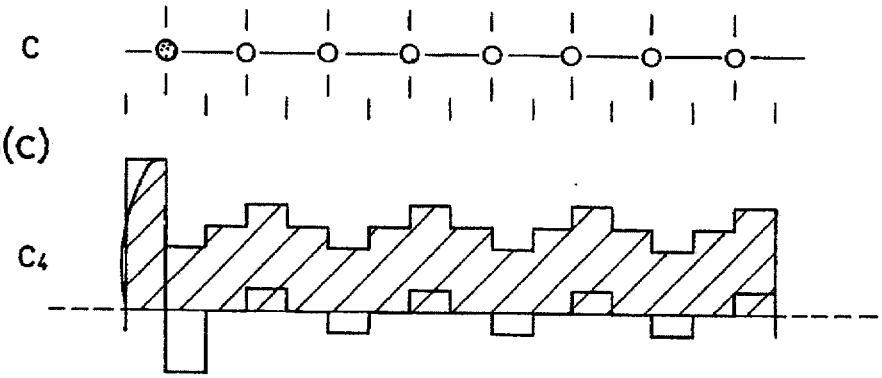

The following description will discuss the influence of crosstalk in the present liquid crystal display. Here, in the same manner as the prior art (see FIG. 14), for convenience of explanation, three display states are shown with respect to the display state of one line that consists of eight pixels: (A) all pixels are turned on; (B) every other pixel is turned on; and (C) only one selected pixel is turned on. Further, the following description deals with only one-line inversion. Since it is easily assumed that the same effects would be obtained from one-line inversion and multiple-line inversion as long as display data are synchronous to the inversion cycle, the descriptions of those cases are omitted.

Figure 2A:
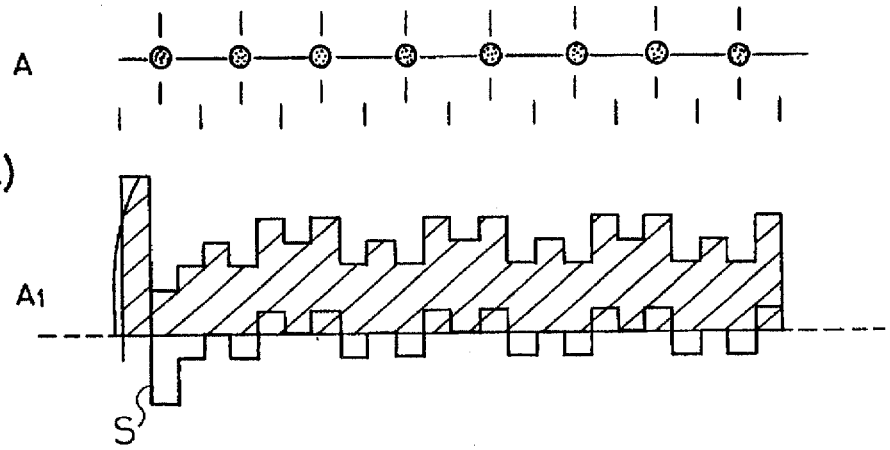
Figure 2B:
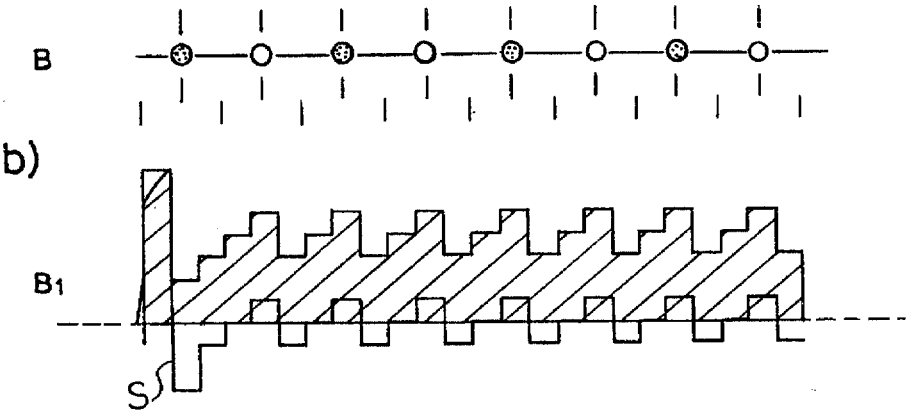
Figure 2C:
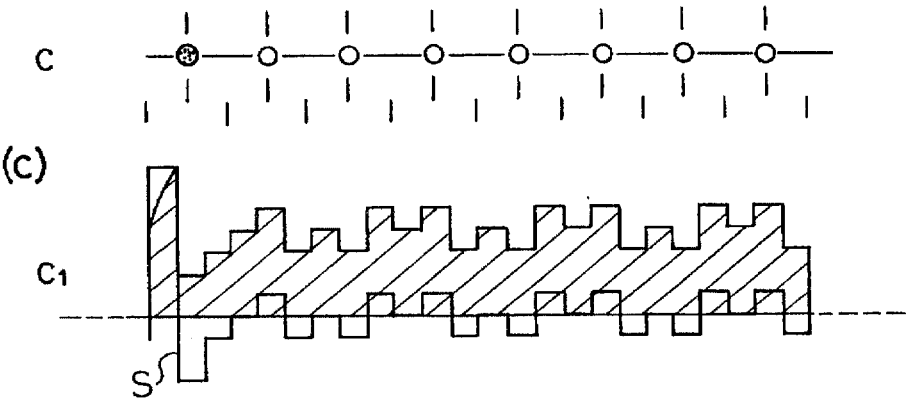

In the above-mentioned display states of A through C (wherein ● represents the on-state and ○ represents the off-state), voltage waveforms, which are to be applied to the respective selected pixels, are indicated by $A_3$~$C_3$ in FIGS. 2(*a*) through 2(*c*). In each of FIGS. 2(*a*) through 2(*c*), a rectangular waveform portion, indicated by a solid line S, represents a waveform of voltage that is composed of three voltages applied by each of the signal electrodes $X_1$ through $X_n$ during the first through third periods $T_1$ through $T_3$ and three voltages applied by each of the scanning electrodes $Y_1$ through $Y_m$ during the same periods, and a shaded portion represents a waveform of voltage that is to be applied to the liquid crystal element 5 through the two-terminal elements 6.

FIGS. 2(*a*) through 2(*c*) indicate that the effective values of the voltages that are to be applied to the respective selected pixels, $A_1$~$C_1$, are equivalent to the above-mentioned shaded portions, and hardly have any differences. Therefore, the use of the driving method of the present embodiment makes it possible to suppress the variations of the effective voltages that are to be applied to the pixels in the above-mentioned three display states, thereby reducing crosstalk to a great degree.

Figure 3:
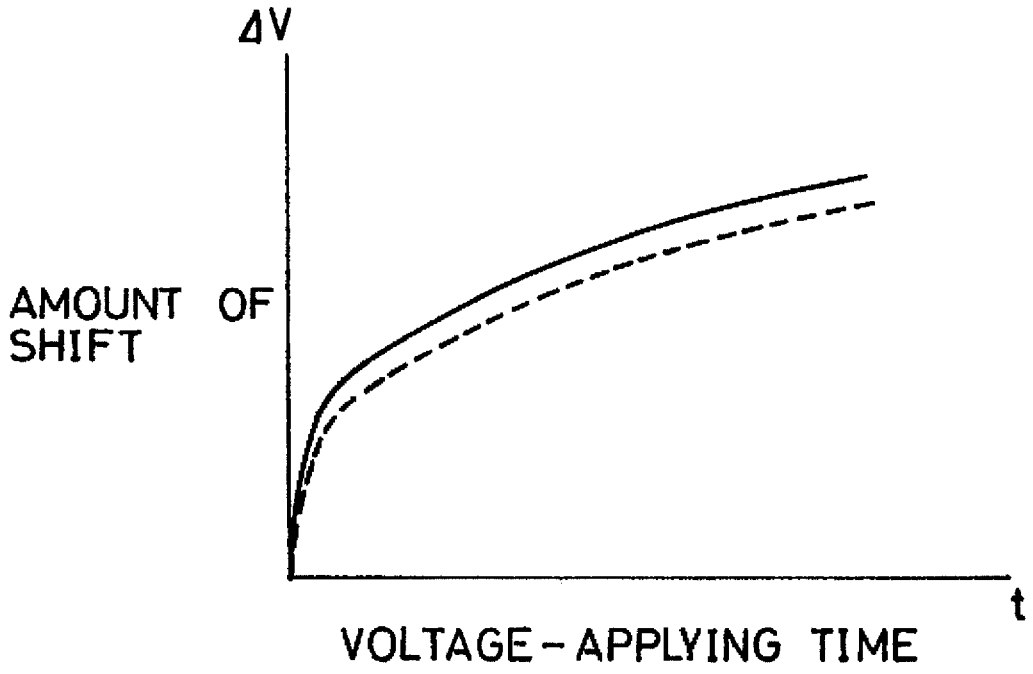
FIG. 3, which are commonly used in each of the embodiments of the present invention, is a graph that shows the variation of the amount of shift in the voltage vs. transmittance characteristic in relation to the voltage-applying time.
Figure 10:
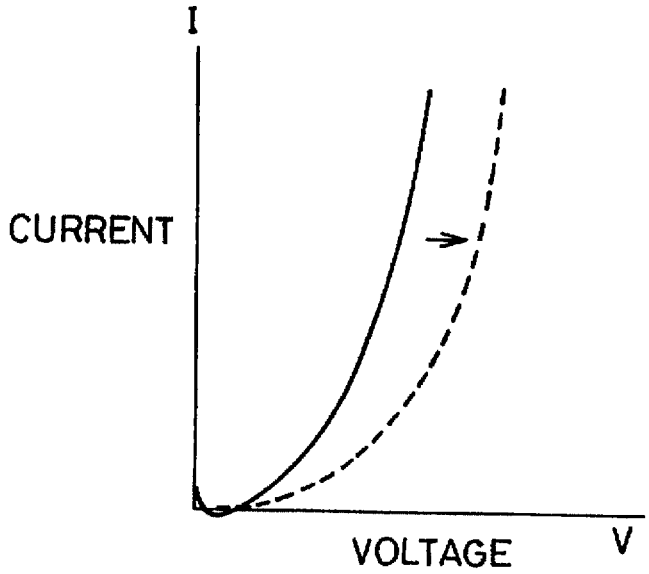
FIG. 10 is a graph that shows a common voltage vs. current characteristic of a non-linear element.
Figure 11:
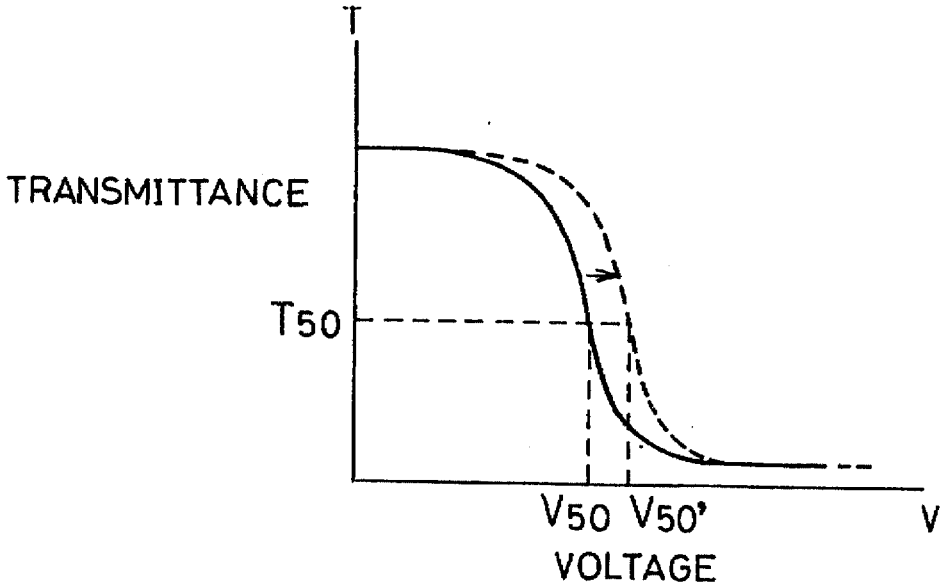
FIG. 11 is a graph that shows the voltage vs. transmittance characteristic of display elements that shifts in accordance with the shift of the characteristic of FIG. 10.
Figure 12:
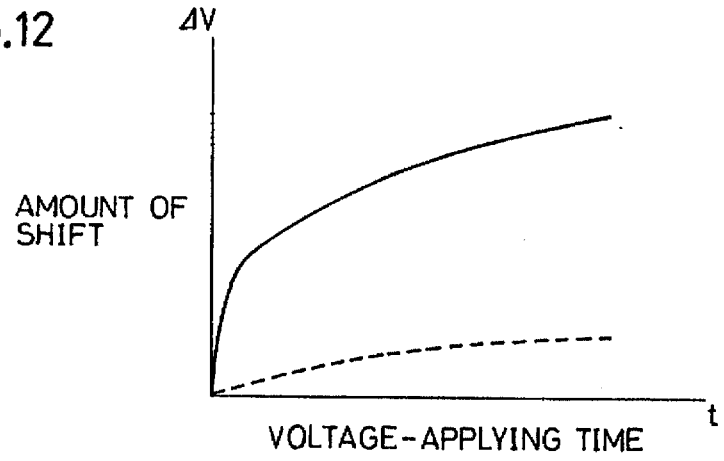
FIG. 12 is a graph that shows the variation of the amount of shift of FIG. 11 in relation to the voltage applying time upon each of on and off times by the use of a conventional driving method.
Figure 13:
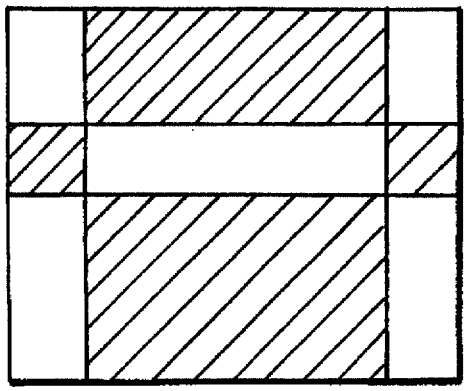
FIG. 13 is an explanatory drawing that shows a display screen on which crosstalk appears.

Here, with respect to the shift in the V-T (voltage versus transmittance) characteristic of the present liquid crystal display (see FIG. 10), FIG. 3 shows the amount of shift in relation to the voltage-applying time. FIG. 3 indicates that the amount of shift upon on-time (represented by a solid line) is virtually the same as the amount of shift upon off-time. This indicates that, compared with the case described in the prior art (see FIG. 12), the difference between the two amounts of shift has reduced to a great degree. Therefore, it becomes possible to virtually eliminate phenomena such as afterimages and seizures.

Figure 4A:
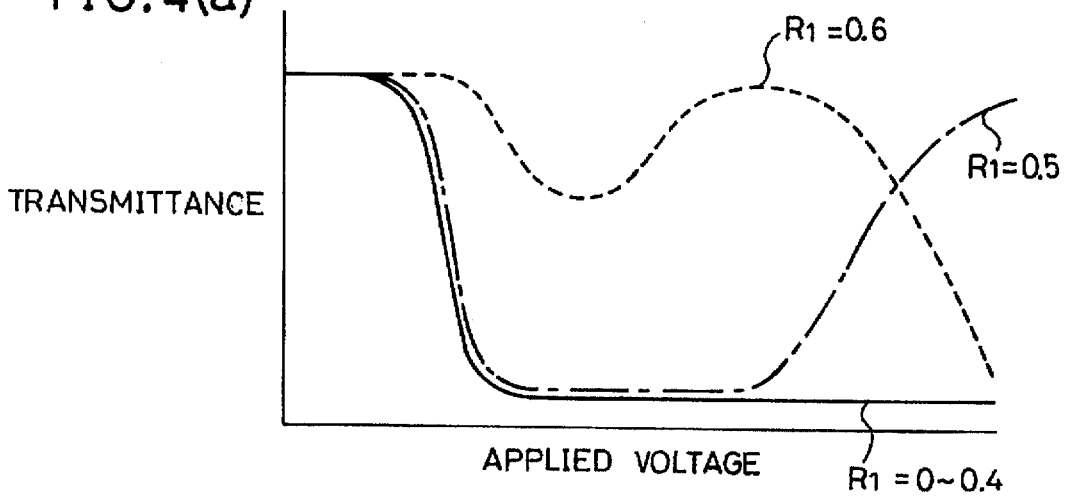
FIG. 4(*a*), which are commonly used in each of the embodiments of the present invention, is a graph that shows the applied voltage vs. transmittance characteristic in the case when the amplitude ratio of selected voltages is changed upon on-time in the driving methods of the two embodiments.
Figure 4B:
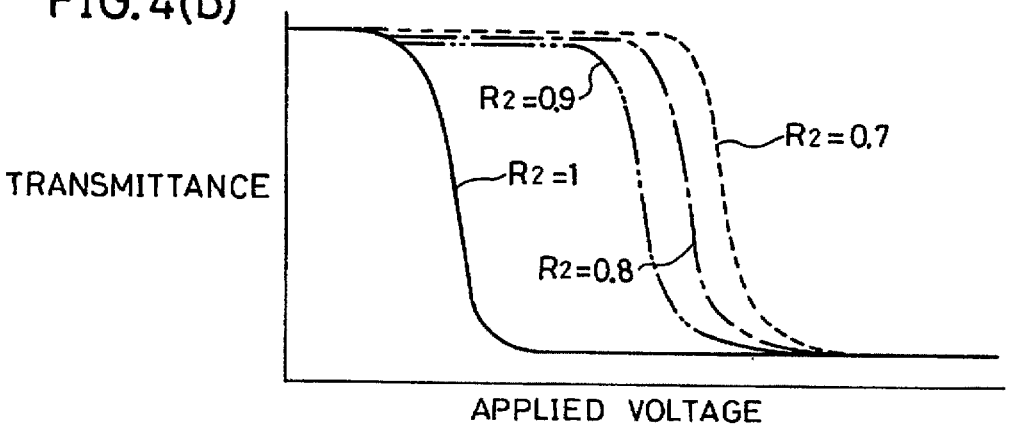

Next, FIG. 4 shows the V-T characteristic in the case when the amplitude ratio of applied voltages during the writing period or the erasing period are changed. FIG. 4(*a*), which shows the characteristic upon on-time, includes respective characteristics when $R_1$=0~0.4, $R_1$=0.5 and $R_1$=0.6, which are respectively indicated by a solid line, an alternate long and short dash line and a broken line. Further, FIG. 4(*b*), which shows the characteristic upon off-time, includes respective characteristics when $R_2$=1, $R_2$=0.9, $R_2$=0.8 and $R_2$=0.7, which are respectively indicated by a solid line, an alternate long and two short dashes line, an alternate long and short dash line and a broken line.

In FIG. 4(*a*), a preferable characteristic upon on-time appears when $R_1$ is within 0~0.4, the characteristic that is typical upon on-time is mixed with the characteristic that is typical upon off-time when $R_1$ is 0.5, and a characteristic that is close to a preferable characteristic upon off-time appears when $R_1$ is 0.6. Moreover, in FIG. 4(*b*), a preferable characteristic upon off-time appears when $R_2$ is set to 0.7, 0.8 and 0.9, and a characteristic that is close to a preferable characteristic upon on-time appears when $R_2$ is 1. Consequently, from FIG. 4(*a*), it is indicated that there is a border between the characteristic of on-time and the characteristic of off-time in the vicinity of $R_1=0.5$.

Therefore, in the case when the voltage $V_{on}$ has the opposite polarity to the voltage $V_{op}$, the contrast between the on-time and off-time can be emphasized if inequalities, $-0.5 \leqq R_1 < 1$ and $-1 < R_2 < -0.5$, are satisfied, and it becomes possible to obtain superior contrast on the display screen. Here, FIGS. 4(*a*) and 4(*b*) indicate that the contrast can be improved particularly in the range of $-0.9 \leqq R_2 \leqq -0.6$.

Additionally, the values of $R_1$ and $R_2$ slightly vary due to the characteristics of the two-terminal element 6. Further, since applied voltages that are originally supposed to be erasing pulses function as writing pulses and cause the pixels to turn on when the amplitude ratio $R_2$ is $-1$, the lower limit of the voltage $V_{off}$ is restricted.

Figure 5:
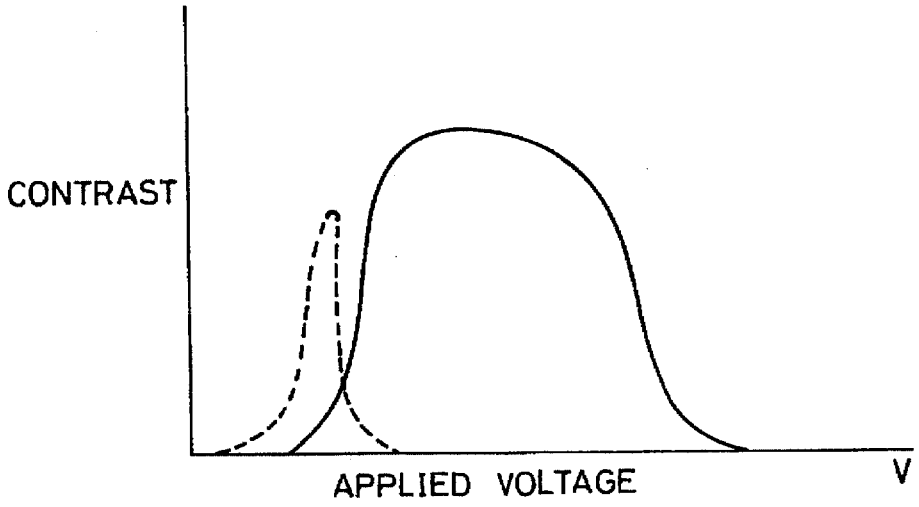
FIG. 5, which is commonly used in each of the embodiments and a conventional liquid crystal display, is a graph that shows the applied voltage vs. contrast characteristic in the respective driving methods.

FIG. 5 shows the applied voltage vs. contrast characteristic. In FIG. 5, a solid line indicates the characteristic obtained by the driving method of the present embodiment and a broken line indicates the characteristic obtained by a conventional driving method. FIG. 5 shows that the use of the driving method of the present embodiment makes it possible to provide better contrast with a wider range of applied voltage, compared with the conventional driving method.

Embodiment 2

Referring to FIGS. 3 through 9, the following description will discuss another embodiment of the present invention. Here, those components that have the same functions as the components described in the above-mentioned Embodiment 1 are indicated by the same reference numerals and the description thereof is omitted.

As illustrated in FIGS. 6 and 7, the liquid crystal display of the present embodiment is also constituted in the same manner as the liquid crystal display that was described in Embodiment 1.

Figure 8:
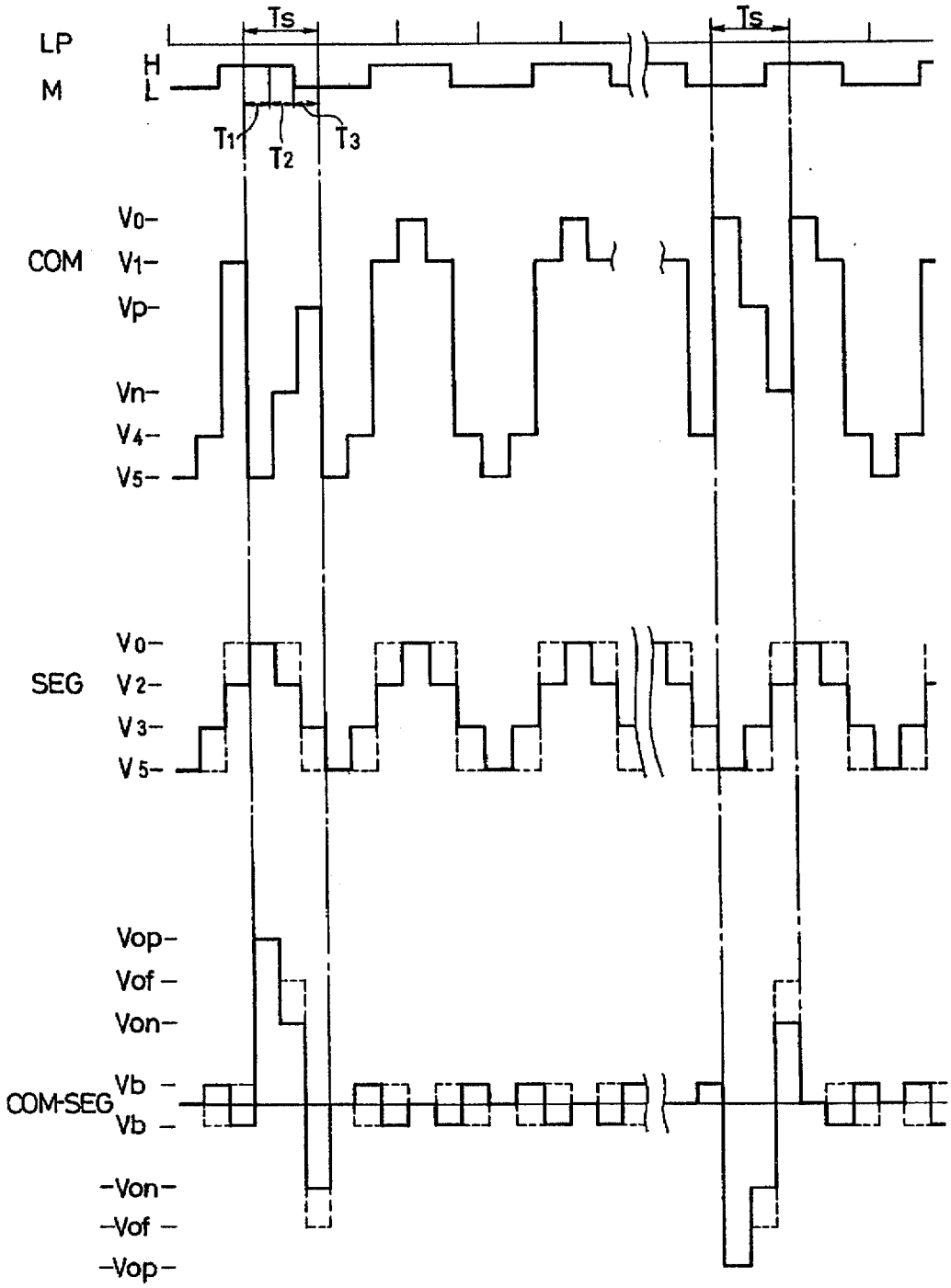
FIG. 8 is a waveform drawing that show signal waveforms to be used for explaining a driving method of a liquid crystal display of another embodiment of the present invention.

As shown in FIG. 8, in the liquid crystal display of the present embodiment also, the selection period $T_s$ is divided into three periods, that is, the first through third periods $T_1$ through $T_3$, and driving voltages are applied during the respective periods.

The first period $T_1$ is a period during which a voltage having not less than a predetermined value is charged to the display element 5 through the two-terminal element 6. The third period $T_3$ is a period during which a voltage having a level that does not cancel the voltage charged during the first period $T_1$ upon the on-time of the liquid crystal element 5, and during which a voltage having a level that cancels the voltage charged during the first period $T_1$ upon the off-time of the liquid crystal element 5, in accordance with display states. The second period $T_2$, which is provided between the first period $T_1$ and the third period $T_3$, is a period during which a voltage that has the same absolute value of the amplitude of the voltage applied during the third period $T_3$ with the polarity opposite thereto is applied.

In FIG. 8 also, with respect to waveforms of COM-SEG, a solid line indicates a waveform upon on-time and a broken line indicates a waveform upon off-time.

The applied voltages during the second period $T_2$ and the third period $T_3$ are set as follows: During the second period $T_2$, supposing that the amplitude of voltage $V_{op}$ is 1, an applied voltage is set so that the amplitude ratio $R_1$ of the applied voltage ($V_{on}$) upon on-time is set in a range from not less than $-0.5$ to not more than 0.5, and that the amplitude ratio $R_2$ of the applied voltage ($V_{off}$) upon off-time is set in a range from more than 0.5 to less than 1. During the third period $T_3$, an applied voltage is set so that the amplitude ratio $R_1$ is set in a range from not less than $-0.5$ to not more than 0.5, and that the amplitude ratio $R_2$ is set in a range from more than $-1$ to less than $-0.5$.

The following description will discuss the influence of crosstalk in the above-mentioned driving method. Here, in the same manner as Embodiment 1, three display states A through C are shown as examples.

Figure 9A:
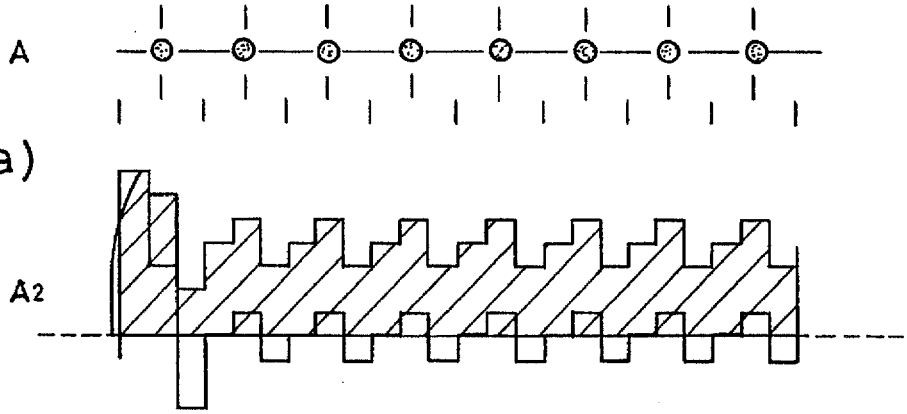
Figure 9B:
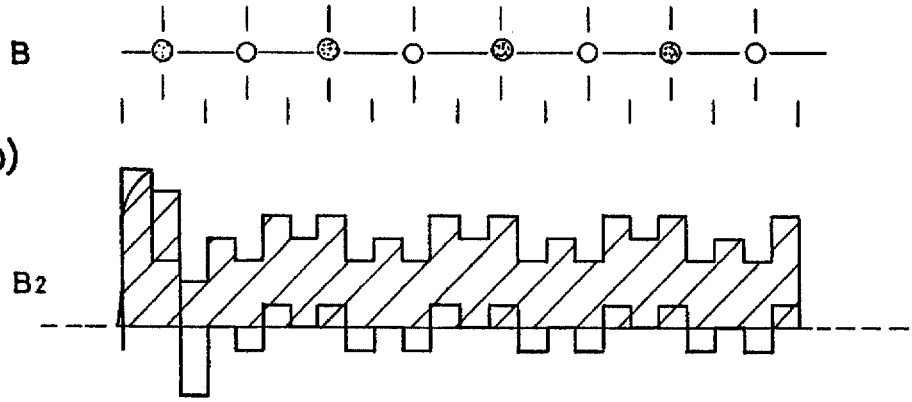
Figure 9C:
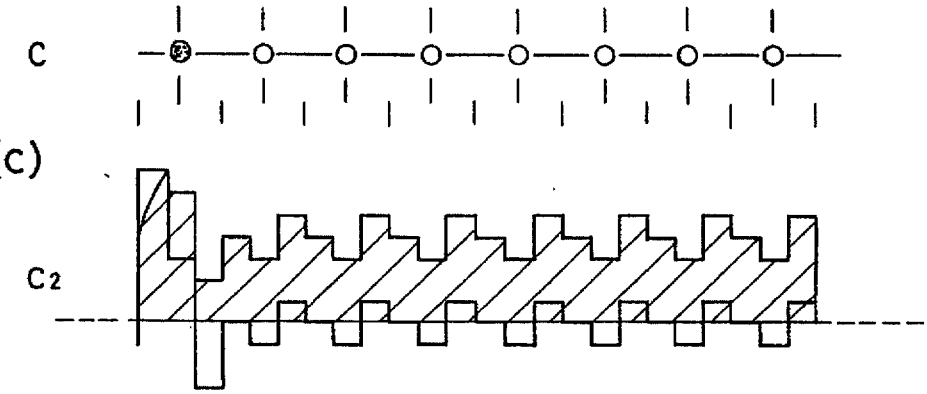

In the above-mentioned display states of A through C, voltage waveforms which are to be applied to the respective selected pixels, are indicated by $A_2$~$C_2$ in FIGS. 9(*a*) through 9(*c*). FIGS. 9(*a*) through 9(*c*) indicate that the effective values of the voltages that are to be applied to the respective selected pixels, $A_2$~$C_2$, (shaded portions) hardly have any differences. Therefore, the use of the driving method of the present embodiment also makes it possible to suppress the variations of the effective voltages that are to be applied to the pixels in the above-mentioned three display states, thereby reducing crosstalk to a great degree.

Moreover, in the present liquid crystal display also, the amount of shift of the V-T characteristic upon on-time is virtually the same as the amount of shift of the V-T characteristic upon off-time, as shown in FIG. 3; this makes it possible to virtually eliminate phenomena such as afterimages and seizures.

Furthermore, in the present liquid crystal display also, the applied voltages are determined by using the amplitude ratios $R_1$ and $R_2$ as shown in FIGS. 4(*a*) and 4(*b*) during the second period $T_2$ and the third period $T_3$, in the same manner as described earlier; therefore, the contrast between the on-time and off-time can be emphasized as shown by a solid line in FIG. 5, and it becomes possible to obtain superior contrast on the display screen. Here, $R_2$ is preferably set in the range of $-0.9 \leqq R_2 \leqq -0.6$ in the same manner as the liquid crystal display of Embodiment 1. This makes it possible to further improve the contrast.

In addition, with respect to voltage variations during the selection period of the driving ICs, Embodiment 1 has a range from $V_0$ to $V_n$ or from $V_5$ to $V_p$; however, the present embodiment has a range from $V_0$ to $V_p$ or from $V_5$ to $V_n$, which is minimized to a great degree. This makes it possible to minimize the load imposed on the driving ICs, and consequently to improve the reliability of the driving ICs as well as achieving low costs of the driving ICs.

Additionally, in the aforementioned Embodiment 1 and the present embodiment, no description was given with respect to gradation. However, conventional gradation systems, which use pulse widths, thinning-out of frames, amplitudes and other factors, may be adopted in combination with the present invention, which is not regarded as a departure from the scope of the present invention.

The invention being thus described, it will be obvious that the same may be varied in many ways. Such variations are not to be regarded as a departure from the spirit and scope of the invention, and all such modification as would be obvious to one skilled in the art are intended to be included within the scope of the following claims.

What is claimed is:

1. A driving method, which is used in a display that is provided with a plurality of signal electrode lines and a plurality of scanning electrode lines that are disposed so as to intersect one another, and a display element and a non-linear element that are connected in series with each other between each signal electrode line and each scanning electrode line at each intersecting portion, comprising the steps of: sequentially selecting the scanning electrode line during each selection period, as well as applying a voltage, which turns on or off the display element connected to the selected scanning electrode line, between the scanning electrode line and signal electrode line so as to drive the display element, the selection period being divided into the first through third periods, said steps, during the selection period, further comprising the steps of:

(a) during the first period, charging a first voltage having not less than a predetermined value to the display element through the non-linear element;

(b) during the second period, applying a second voltage that has a level that does not cancel the first voltage upon on-time, as well as applying a second voltage that has a level that cancels the first voltage upon off-time; and (c) during the third period, applying a third voltage that forms a non-selection level with the opposite polarity to the first voltage upon on-time, as well as applying a third voltage that forms a non-selection level with the same polarity as the first voltage upon off-time.

2. The driving method as defined in claim 1, wherein, supposing that the first voltage is 1, the amplitude ratio of the second voltage to the first voltage is set in a range from not less than −0.5 to less than 1 upon on-time, as well as set in a range from more than −1 to less than −0.5 upon off-time, while the third voltage is set to have an amplitude of ½ of the amplitude difference of the two second voltages upon the on- and off-times, and also to be applied with opposite polarities during the second and third periods of the first through third periods in the non-selection period that has been divided in the same manner as the selection period.

3. The driving method as defined in claim 2, wherein the amplitude ratio of the second voltage to the first voltage is set in a range from not less than −0.9 to not more than −0.6 upon off-time.

4. A driving method, which is used in a display that is provided with a plurality of signal electrode lines and a plurality of scanning electrode lines that are disposed so as to intersect one another, and a display element and a non-linear element that are connected in series with each other between each signal electrode line and each scanning electrode line at each intersecting portion, comprising the steps of: sequentially selecting the scanning electrode line during each selection period, as well as applying a voltage, which turns on or off the display element connected to the selected scanning electrode line, between the scanning electrode line and signal electrode line so as to drive the display element, the selection period being divided into the first through third periods, said steps, during the selection period, further comprising the steps of:

(a) during the first period, charging a first voltage having not less than a predetermined value to the display element through the non-linear element;

(b) during the second period, applying a second voltage that has the opposite polarity to a third voltage but has the same absolute value of an amplitude of the third voltage that is to be applied during the third period; and (c) during the third period, applying a third voltage that has a level that does not cancel the first voltage upon on-time, as well as applying a third voltage that has a level that cancels the first voltage upon off-time.

5. The driving method as defined in claim 4, wherein, supposing that the first voltage is 1, the amplitude ratio of the second voltage to the first voltage is set in a range from not less than −0.5 to not more than 0.5 upon on-time, as well as set in a range from more than 0.5 to less than 1 upon off-time, while the amplitude ratio of the third voltage to the first voltage is set in a range from not less than −0.5 to not more than 0.5 upon on-time, as well as set in a range from more than −1 to less than −0.5 upon off-time.

6. The driving method as defined in claim 5, wherein the amplitude ratio of the third voltage to the first voltage is set in a range from not less than −0.9 to not more than −0.6 upon off-time.

7. A display device apparatus comprising:

a plurality of signal electrode lines;

a plurality of scanning electrode lines that are disposed so as to intersect the signal electrode lines;

a display element and a non-linear element that are connected in series with each other between each signal electrode line and each scanning electrode line at each intersecting portion;

a scanning-electrode driving circuit for sequentially selecting the scanning electrode line during each selection period;

a signal-electrode driving circuit for applying a voltage, which turns on or off the display element connected to the selected scanning line, between the scanning electrode line and signal electrode line; and a control section which, during the selection period divided into first through third periods, allows the scanning-electrode driving circuit and the signal-electrode driving circuit to carry out the steps of:

(a) during the first period, charging a first voltage having not less than a predetermined value to the display element through the non-linear element;

(b) during the second period, applying a second voltage that has a level that does not cancel the first voltage upon on-time, as well as applying a second voltage that has a level that cancels the first voltage upon off-time; and (c) during the third period, applying a third voltage that forms a non-selection level with the opposite polarity to the first voltage upon on-time, as well as applying a third voltage that forms a non-selection level with the same polarity as the first voltage upon off-time.

8. The display device as defined in claim 7, wherein the control section controls the scanning-electrode driving circuit and the signal-electrode driving circuit so that, supposing that the first voltage is 1, the amplitude ratio of the second voltage to the first voltage is set in a range from not less than −0.5 to less than 1 upon on-time, as well as set in a range from more than −1 to less than −0.5 upon off-time, while the third voltage is set to have an amplitude of ½ of the amplitude difference of the two second voltages upon the on- and off-times, and also to be applied with opposite polarities during the second and third periods of the first through third periods in the non-selection period that has been divided in the same manner as the selection period.

9. The display device as defined in claim 8, wherein the control section controls the scanning-electrode driving circuit and the signal-electrode driving circuit so that the amplitude ratio of the second voltage to the first voltage is set in a range from not less than −0.9 to not more than −0.6 upon off-time.

10. A display device apparatus comprising:

a plurality of signal electrode lines;

a plurality of scanning electrode lines that are disposed so as to intersect the signal electrode lines;

a display element and a non-linear element that are connected in series with each other between each signal electrode line and each scanning electrode line at each intersecting portion;

a scanning-electrode driving circuit for sequentially selecting the scanning electrode line during each selection period;

a signal-electrode driving circuit for applying a voltage, which turns on or off the display element connected to the selected scanning line, between the scanning electrode line and signal electrode line so as to drive the display element; and a control section which, during the selection period divided into first through third periods, allows the scanning-electrode driving circuit and the signal-electrode driving circuit to carry out the steps of:

(a) during the first period, charging a first voltage having not less than a predetermined value to the display element through the non-linear element;

(b) during the second period, applying a second voltage that has the opposite polarity to a third voltage but has the same absolute value of an amplitude of the third voltage that is to be applied during the third period; and (c) during the third period, applying a third voltage that has a level that does not cancel the first voltage upon on-time, as well as applying a third voltage that has a level that cancels the first voltage upon off-time.

11. The display device as defined in claim 10, wherein the control section controls the scanning-electrode driving circuit and the signal-electrode driving circuit so that, supposing that the first voltage is 1, the amplitude ratio of the second voltage to the first voltage is set in a range from not less than −0.5 to not more than 0.5 upon on-time, as well as set in a range from more than 0.5 to less than 1 upon off-time, while the amplitude ratio of the third voltage to the first voltage is set in a range from not less than −0.5 to not more than 0.5 upon on-time, as well as set in a range from more than −1 to less than −0.5 upon off-time.

12. The display device as defined in claim 11, wherein the control section controls the scanning-electrode driving circuit and the signal-electrode driving circuit so that the amplitude ratio of the third voltage to the first voltage is set in a range from not less than −0.9 to not more than −0.6 upon off-time.

* * * * *